United States Patent [19]

Maybrier et al.

[11] Patent Number: 4,699,429

[45] Date of Patent: Oct. 13, 1987

[54] MINING MACHINE SYSTEM

[76] Inventors: William H. Maybrier, P.O. Box 684, Barbourville, Ky. 40906; Gary K. Chastain, Eastern Kentucky Univ., Ault 245, Richmond, Ky. 40475

[21] Appl. No.: 799,341

[22] Filed: Nov. 18, 1985

[51] Int. Cl.[4] ..... E21D 9/08

[52] U.S. Cl. ..... 299/7; 299/33; 299/56

[58] Field of Search ..... 299/7, 55, 56, 58, 33, 299/90

[56] References Cited

U.S. PATENT DOCUMENTS

| | | | |
|---|---|---|---|
| 2,669,441 | 2/1954 | Castaroli et al. | 299/55 |
| 3,131,916 | 5/1964 | Adams et al. | 299/55 |
| 3,314,724 | 4/1967 | Tinlin . | |
| 3,334,945 | 8/1967 | Bartlett | 299/56 |
| 3,830,545 | 8/1974 | Sugden | 299/33 |
| 3,857,490 | 12/1974 | Wilcox | 209/250 |
| 3,993,355 | 11/1976 | Cunningham | 299/31 |
| 4,021,076 | 5/1977 | Hawthorne et al. | 299/56 |
| 4,298,230 | 11/1981 | Krabbe | 299/58 X |
| 4,305,620 | 12/1981 | Hart | 299/7 |
| 4,330,155 | 5/1982 | Richardson et al. | 299/11 |
| 4,555,064 | 11/1985 | Asano et al. | 299/90 X |
| 4,556,256 | 12/1985 | Follert et al. | 299/55 X |

*Primary Examiner*—Stephen J. Novosad
*Assistant Examiner*—David J. Bagnell
*Attorney, Agent, or Firm*—King & Schickli

[57] ABSTRACT

A mining machine system for deep boring a hole in a seam includes a cutting head, a drill pipe, a power unit for driving the cutting head, a recovery mechanism for the fluidized conveyance of the aggregate coal or other mineral product from the bore hole and a blocking unit. The blocking unit includes a substantially cylindrical frame member that substantially conforms to the diameter of the hole being bored by the cutting head. Thus, the blocking unit serves to support the weight of the cutting head and drill pipe so as to maintain the proper alignment of the cutting head in the seam. The aggregate coal or other product may be conveyed from the bore hole adjacent the cutting head to the seam face either through a coal conveyance passageway in the drill pipe or through a separate coal conveyance pipe. In either embodiment a sealed pipe extending unit is provided to extend or advance the coal conveying pipe or drill pipe into the bore hole with the cutting head.

22 Claims, 11 Drawing Figures

MINING MACHINE SYSTEM

TECHNICAL FIELD

The present invention relates generally to the art of mining and, more particularly, to an improved mining system for winning minerals by boring a hole in a mineral seam.

BACKGROUND OF THE ART

Coal, formed from decomposed and compressed vegetable matter, is typically found in substantially horizontal seams extending between sedimentary rock strata such as limestone, sandstone, or shale. Surface and underground mining are the primary techniques used to recover this coal.

Surface or strip mining involves removal of material (known as overburden) overlying a coal seam so as to expose the coal for recovery. In recent years, surface mining has gained prominence over underground mining in the United States. This is due to many factors including: (a) the increased material moving capacity of surface or strip mining equipment; (b) lower costs for surface mining than underground mining; (c) the better safety record of surface mining versus underground mining; (d) a higher coal recovery percentage for surface mining versus underground mining; and (e) many coal reserves favor extraction by surface mining due to geologic factors.

Surface mining does, however, have its limitations despite the advantages cited above. The primary limiting factor relates to the depth of the overburden. Once the coal seam reaches a certain depth below the surface, the amount of overburden that must be removed to reach the coal simply makes strip mining economically unfeasible.

Once this depth is reached, large quantities of coal may still remain in the ground and other mining methods must be utilized if economic recovery of this coal is to be achieved. Underground mining application in such an instance is, however, very limited. This may be due to poor roof support conditions, the thinness of the seam and/or the presence of insufficient quantities of coal to warrant the large capital investments characteristic of underground operations.

Due to these considerations, auger mining is often used to recover coal following a strip mining operation where the overburden becomes too costly to remove. A large auger is used to bore into the face of the seam and recover the coal from beneath the overburden. Advantageously, auger mining is very efficient providing more tons per man day than any other form of mining. Auger mining also may be activated quickly and requires a relatively low capital expenditure when compared to surface and underground mining.

Thus, auger mining may be used to supplement a strip mining operation and to recover smaller coal deposits. Auger mining really does not compete with underground mining that requires the large reserves, as well as the substantial capital and time to develop. Auger mining is the best method to use in relatively thin seams. Further, auger mining is safer than both surface and underground mining, while also providing a generally cleaner coal product.

Auger mining is, however, also not without its disadvantages. Despite the high rate of production, auger mining provides a relatively low total coal recovery. Coal recovery for the resource area being augered is usually less than about 35%. Some of the lost recovery is due to the pillars of coal that are left standing to support the overburden between adjacent auger holes. The majority of the recovery shortfall, however, is due to the limited penetration depths achievable with the present auger mining equipment.

The present augering equipment characteristically drills holes that sag downwardly gradually with increasing depth of penetration into the coal seam. Eventually, the auger tends to drill through the bottom of the coal seam into the underlying rock layer. Disadvantageously, this can lead not only to dirty coal (i.e. coal contaminated with other materials) and reduced coal recovery per drilling foot, but also to expensive cutting head damage and even cutting head loss. Thus, in actual practice, each auger hole is started at the top of the seam and drilled 30% under size (i.e. in relation to the height of the coal seam) to allow for the sagging caused by the weight of the cutting head and drill steel during auger operation.

Further, as penetration depths increase, a greater number of auger flights are required to convey the coal from the cutting head to the seam face for recovery. Each flight adds to the frictional resistance to the turning of the auger through contact with the walls of the bore hole. Additionally, the longer the string of auger flights, the greater the weight of coal being moved by the flights at any one time. As a result, it should be appreciated that auger power requirements increase rapidly with the depth of auger penetration.

Holes drilled with conventional augering equipment are usually only of a depth of 150 feet, with 200 feet being rarely obtainable. Of course, any increase in this figure is desirable as it would greatly improve the coal recovery rate from a resource area.

SUMMARY OF THE INVENTION

Accordingly, it is a primary object of the present invention to provide an improved mineral winning apparatus or system overcoming the above-described limitations and disadvantages of conventional auger mining equipment.

Another object of the present invention is to provide a mineral winning machine for boring a series of holes in a mineral seam with an improved overall recovery rate.

A further object of the present invention is to provide a mineral winning machine or system that reduces friction during coal recovery and, therefore, the power requirements of the drilling equipment for improved operating efficiency as well as operation to greater depths into the seam face.

A more specific object of the present invention is to provide an improved boring apparatus that is more stable and maintains the cutting head of the apparatus within the coal seam so as to allow a head of greater diameter to be used for increased coal recovery per drilling foot.

A further object of the present invention is to provide a mineral winning apparatus for boring holes in a mineral face of increased depth while maintaining the cutting head of the apparatus aligned within the seam.

Additional objects, advantages, and other novel features of the present invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved mining machine system is provided for boring holes of greater circumference and depth in a coal or mineral seam. The improved system includes means, such as a rotary cutting head, for boring a hole in the coal seam and reducing the coal to aggregate. The rotary cutting head is connected by a length of drill pipe to a power drilling unit that rotates the cutting head. A blocking unit is positioned along the drill pipe adjacent the cutting head. The blocking unit forms an enclosed chamber with the walls of the bore hole adjacent the cutting head. The aggregate coal cut by the cutting head is then recovered through fluidized conveyance from the enclosed chamber to a collection location, such as a cyclone separator or the like.

Preferably, the blocking unit includes a substantially cylindrical frame member having support plates at least at each end that receive the drill pipe. Thrust bearings between each support plate and the drill pipe allow rotation of the drill pipe relative to the blocking unit. Further, the thrust bearings maintain the position of the blocking unit along the drill pipe adjacent the cutting head, as the pipe is extended further into the bore hole during drilling.

The blocking unit is of a diameter substantially the same as or slightly smaller than the cutting head so as to substantially conform to the bore hole. Thus, the blocking unit can move into the hole, seal the hole and also support the weight of the drill pipe and cutting head. This arrangement substantially eliminates "sag" and maintains the alignment of the cutting head within the seam. As a consequence, boring to greater depths within the seam with a cutting head of increased circumference is possible. The blocking unit includes an outer peripheral layer of resilient material, such as outwardly extending ridges of neoprene, for engaging the bore hole wall and assisting the sealing of the enclosed chamber at the end of the bore hole.

In one embodiment, a pressurized fluid source, such as an air compressor, provides high pressure air to the sealed bore hole chamber through the drill pipe. An aggregate coal conveying pipe extends through the blocking unit providing communication between the sealed chamber and the collection location. The high pressure air from the compressor serves to fluidize, lift and convey the aggregate coal more efficiently from the chamber adjacent the cutting head to the collection location. Thus, it should be appreciated that the need for auger flights to convey the coal is eliminated and, therefore, friction and overall power requirements of the drilling apparatus are reduced.

A unit for extending or advancing the coal conveying pipe with the cutting head and blocking unit into the bore hole is also provided. The conveying pipe extending unit includes a housing forming a sealed enclosure for maintaining the increased air pressure that conveys the aggregate coal. An automatic controller, such as a microprocessor, controls the delivery and connection of an additional length of coal conveying pipe as required during mining machine operation. A limit switch connected to the controller activates the controller to initiate the pipe delivery and connection cycles prior to the joint end of the pipe being extended from the sealed enclosure of the unit. Thus, fluidized coal conveyance is maintained even during connection of an additional length of pipe. Specifically, aggregate coal conveyed through the coal conveying pipe is delivered from the distal end of the pipe to the sealed enclosure of the advancing unit. The coal is then conveyed by the pressurized air from the unit through a separator delivery pipe to the separator for final processing.

An inclined ramp and pivotal lever are used to deliver a single length of pipe at a time for threadably connecting to the end of the coal conveying pipe in the enclosure. A cradle receives the additional length of pipe. The cradle is mounted for reciprocal movement along the longitudinal axis of the pipe so as to bring the additional length of pipe into engagement with the joint end. Powered rollers on the cradle rotate the additional length of pipe and securely connect it to the end of the coal conveying pipe.

In a second embodiment, an enlarged drill pipe is used defining an interior coal conveyance passageway. A connector at the end of the enlarged drill pipe connects the drill pipe to the cutting head. The connector comprises two substantially U-shaped frame members oriented in planes substantially perpendicular to each other. Openings in the connector between the crossed U-shaped frame members communicate with the coal conveyance passageway in the drill pipe and allow for entry of fluidized aggregate coal.

The end of the drill pipe adjacent the powered drilling unit is connected to a source of suction to fluidize and draw the coal through the passageway in the drill pipe to the collection location. Vent openings in the blocking unit allow the entry of air into the enclosed chamber of the bore hole to provide the air for fluidizing and moving the coal.

BRIEF DESCRIPTION OF THE DRAWING

The accompanying drawing incorporated in and forming a part of the specification, illustrates several aspects of the present invention, and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
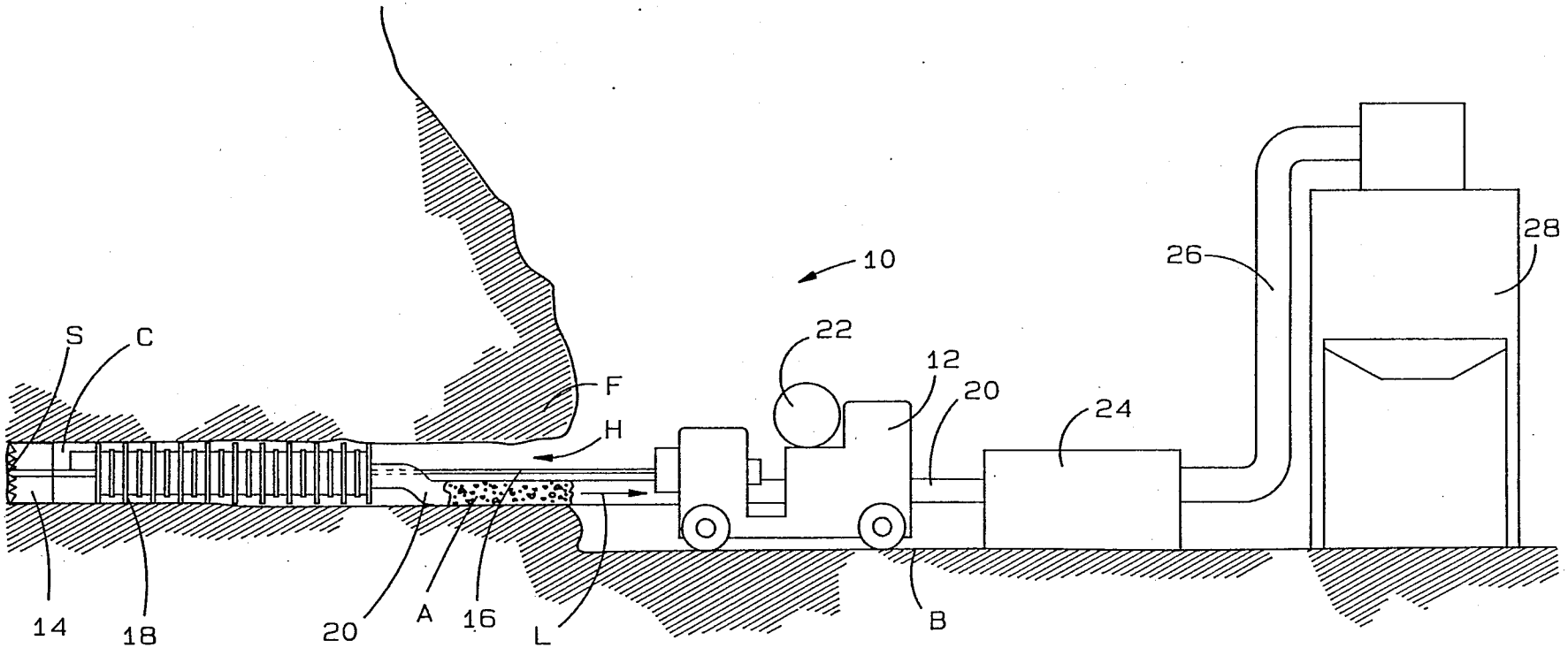
FIG. 1 is a schematic view of the overall mining machine system of the present invention for boring a hole in a mineral seam.

With reference to FIG. 1, the improved mining machine system 10 of the present invention is shown boring a hole in a mineral seam, such as an exposed coal seam following strip mining. The system 10 includes a motorized power drilling unit 12, as is known in the art, for driving a cutting head 14 and boring a hole H in coal seam S. The drilling unit 12 is connected to the cutting head 14 by a drill pipe 16. Additional lengths of pipe are added to the drill pipe 16, as required as is known in the art, to increase the drilling depth into the coal seam.

A blocking unit 18 substantially conforming to the circumference of the bore hole H is positioned along the drill pipe 16 adjacent the cutting head 14. As described in greater detail below, the blocking unit 18 supports the weight of the drill pipe 16 and cutting head 14 to maintain the angle of boring or cutting substantially constant so that greater boring depths are reachable with the apparatus of the present invention.

A coal conveying pipe 20 is connected to the blocking unit 18. Pressurized air from the compressor 22 of the drilling unit 12 is directed down through the drill pipe 16 to the enclosed bore hole chamber C between the blocking unit 18 and the end of the bore hole H adjacent the cutting head 14. The pressurized air then fluidizes and picks up the aggregate coal A cut by the cutting head 14 and conveys the coal back through the coal conveying pipe 20 (note action arrow L) toward the bench B at the mine face F. The aggregate coal is delivered from the coal conveying pipe 20 into the coal conveying pipe extending unit 24. From the extending unit 24, the coal is conveyed in separator delivery pipe 26 to a cyclone separator 28 that filters the air exhaust and removes the coal for subsequent delivery to ultimate users.

Figure 2:
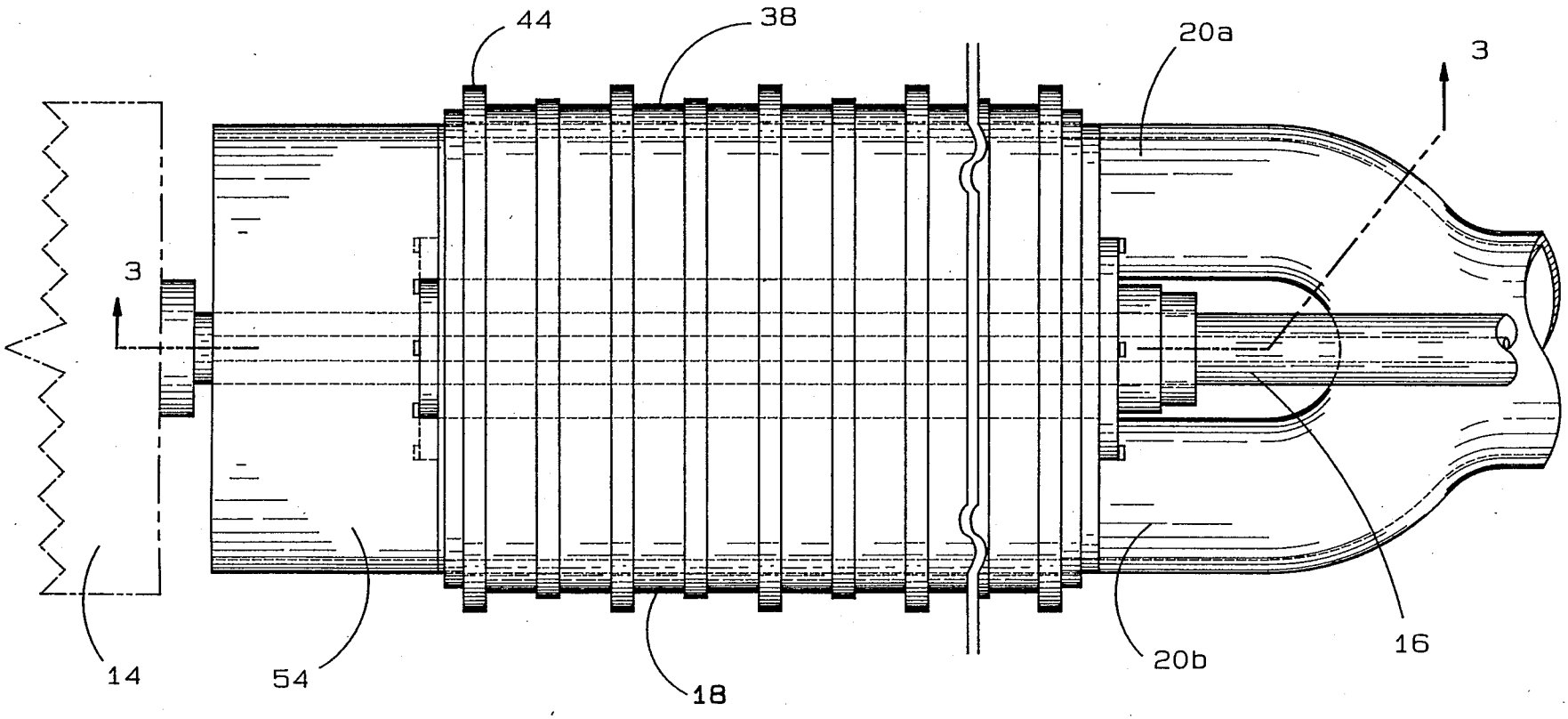
FIG. 2 is a top plan view of the cutting head and blocking unit of the system that bores into the seam.
Figure 3:
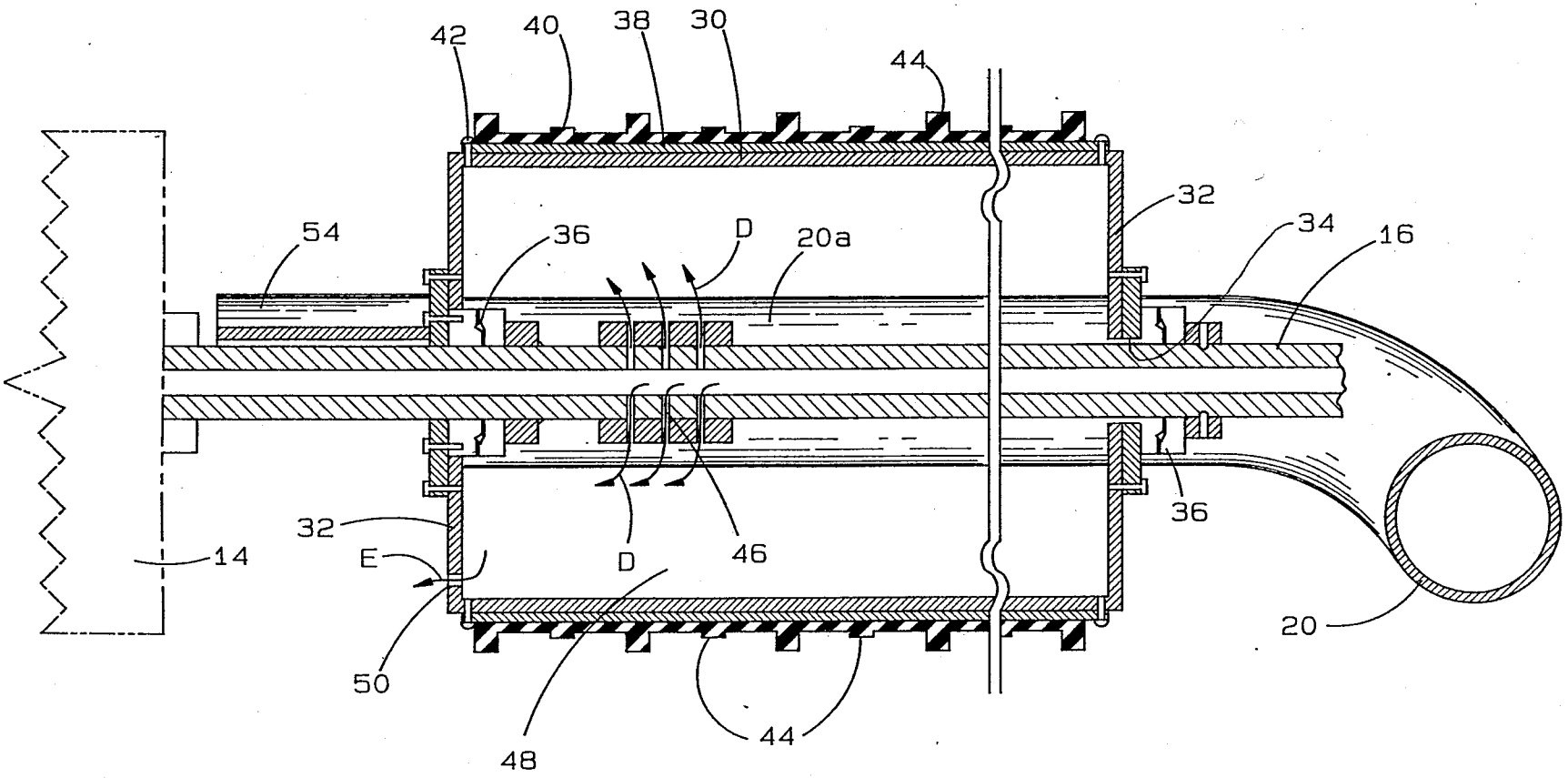
FIG. 3 is a cross-sectional view along line 3—3 of FIG. 2.
Figure 4:
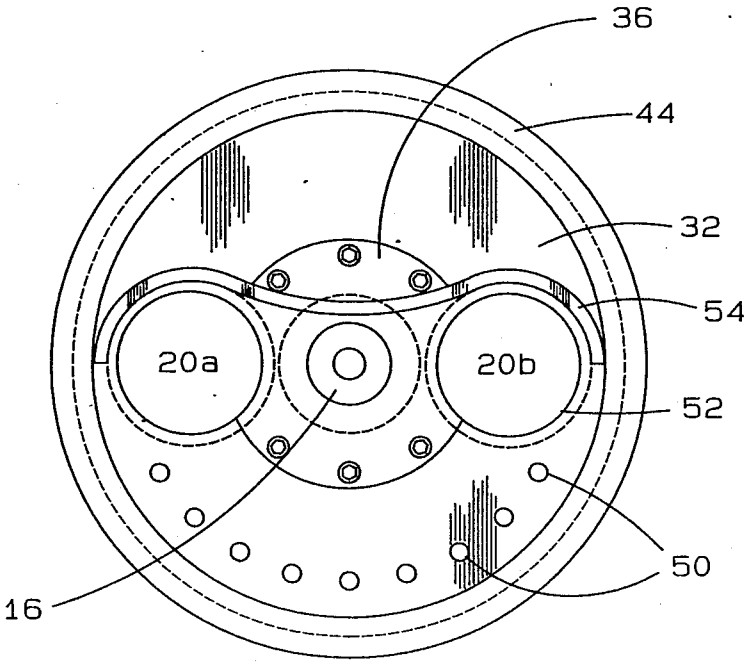
FIG. 4 is a front elevational view of the blocking unit as shown in FIG. 2 with the rotary cutting head removed.

As best shown in FIGS. 2–4 in combination, the blocking unit 18 includes a substantially cylindrical frame member 30. Solid support plates or members 32 are provided at least at each end of the frame member 30. Each support plate 32 includes a central aperture 34 for the free passage of the drill pipe 16 to the cutting head 14. Thrust bearings, generally designated by reference numeral 36, are mounted to each support plate 32 and engage the drill pipe 16. The thrust bearings 36 allow rotation of the drill pipe 16 relative to the blocking unit 18. Additionally, the thrust bearings 36 maintain the longitudinal positioning of the blocking unit 18 along the drill pipe 16 so that the blocking unit remains the same distance from the cutting head 14 even as the cutting head advances into the coal seam S.

The blocking unit 18 also includes an outer peripheral layer of resilient material 38, such as neoprene, mounted to a sleeve 40. The sleeve 40 and resilient material 38 may be fastened to the cylindrical frame member 30 by bolts 42 or other known means. Ridges 44 of neoprene assure maximum sealing action between the blocking unit 18 and the adjacent bore hole wall. Thus, the blocking unit 18 substantially seals the bore hole chamber C for pressurized conveyance and recovery of the coal from the chamber as described below.

As shown, the aggregate coal conveying pipe 20 is substantially Y-shaped adjacent the blocking unit 18 with two feed pipes 20*a*, 20*b*, extending through the support plates 32 of the blocking unit and communicating with the enclosed bore hole chamber C.

Air from the compressor 22 is pumped down through the drill pipe 16 to remove cuttings from the cutting head 14 as is known in the art. Some of the air, however, is directed through the feed openings 46 in the drill pipe 16 (note action arrows D) into the interior section 48 of the blocking unit 18. Pressurized air is then directed through the delivery ports 50 in the support plate 32 adjacent the cutting head 14 (note the action arrow E). As the air passes through the ports 50, it is directed upwardly toward the coal conveying feed pipe openings 52. Thus, the pressurized air from the ports 50 serves to efficiently fluidize and lift aggregate coal cut by the cutting head 14 toward the coal conveying pipes 20*a*, 20*b* for delivery to the collection location. As shown, a deflector hood 54 just above and adjacent the upper edge of the coal conveying feed pipe openings 52 further serves to direct the aggregate coal into the coal conveying pipes 20*a*, 20*b* for recovery.

In order to assure smooth, efficient operation, the coal conveying pipe 20 must be extended so that it too may be advanced into the bore hole H with the cutting head 14, the drill pipe 16 and the blocking unit 18. This is done in the coal conveying pipe extending unit 24 shown in detail in FIGS. 5 and 6.

Figure 6:
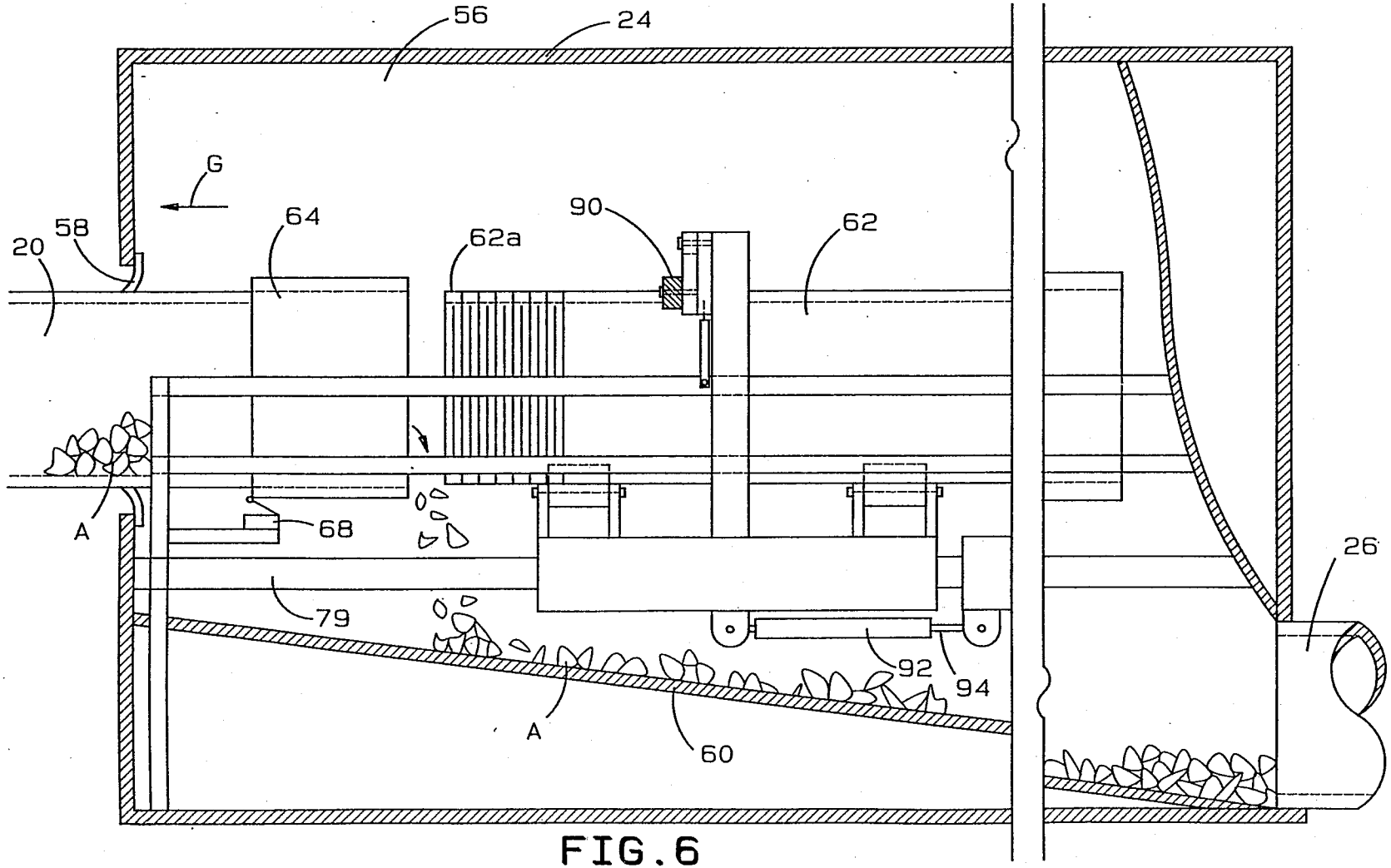
FIG. 6 is a cross-sectional view along line 6—6 of FIG. 5.
Figure 7:
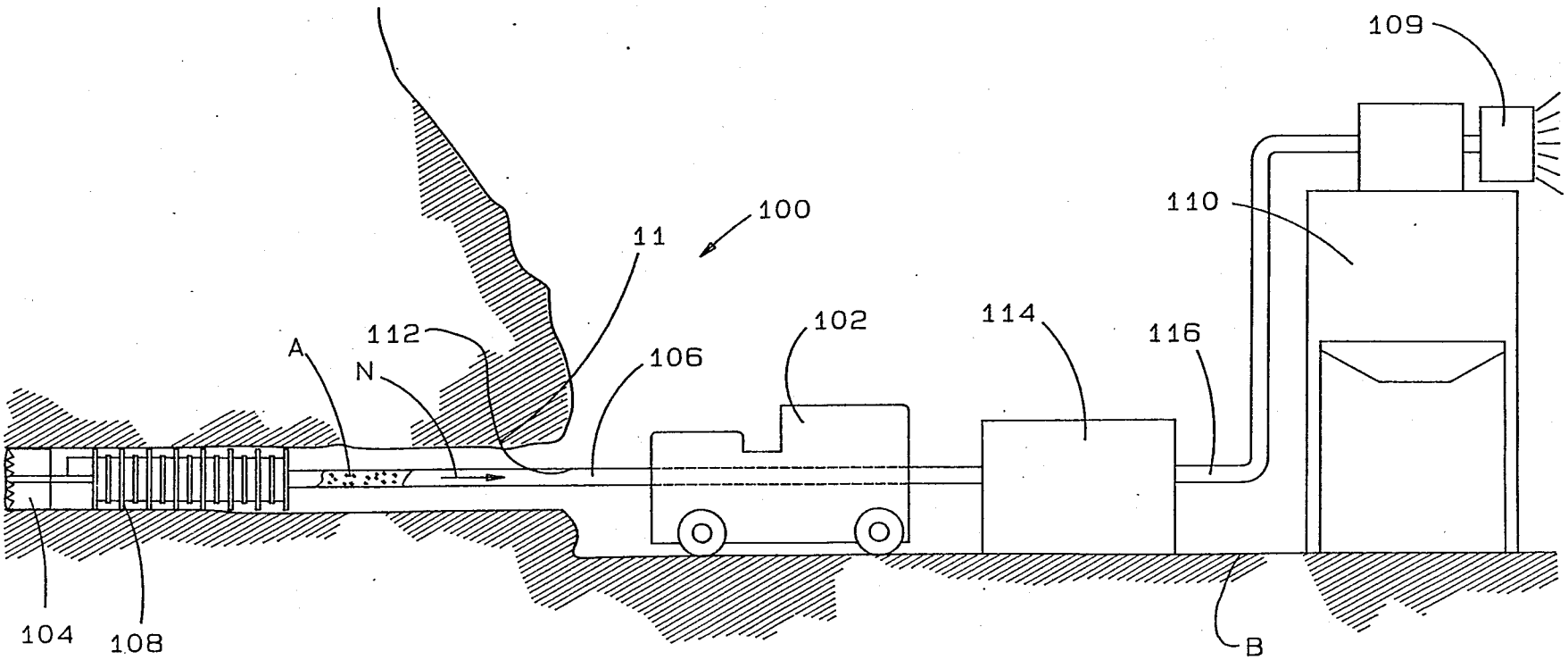
FIG. 7 is a schematic view of an alternative embodiment of the present invention.

As shown in FIG. 6, the extending unit 24 includes a sealed enclosure 56. The coal conveying pipe 20 extends into this sealed enclosure 56 through an aperture including a rubber sealing member 58. Coal A conveyed in the pipe 20 by the pressurized air from the compressor 22 is dispensed from the end of the coal conveying pipe 20 into the enclosure 56. The coal then moves down the inclined surface 60 toward the separator delivery pipe 26. As shown in FIG. 1, the coal is then conveyed by the high pressure air through this pipe 26 to the separator 28.

Figure 5:
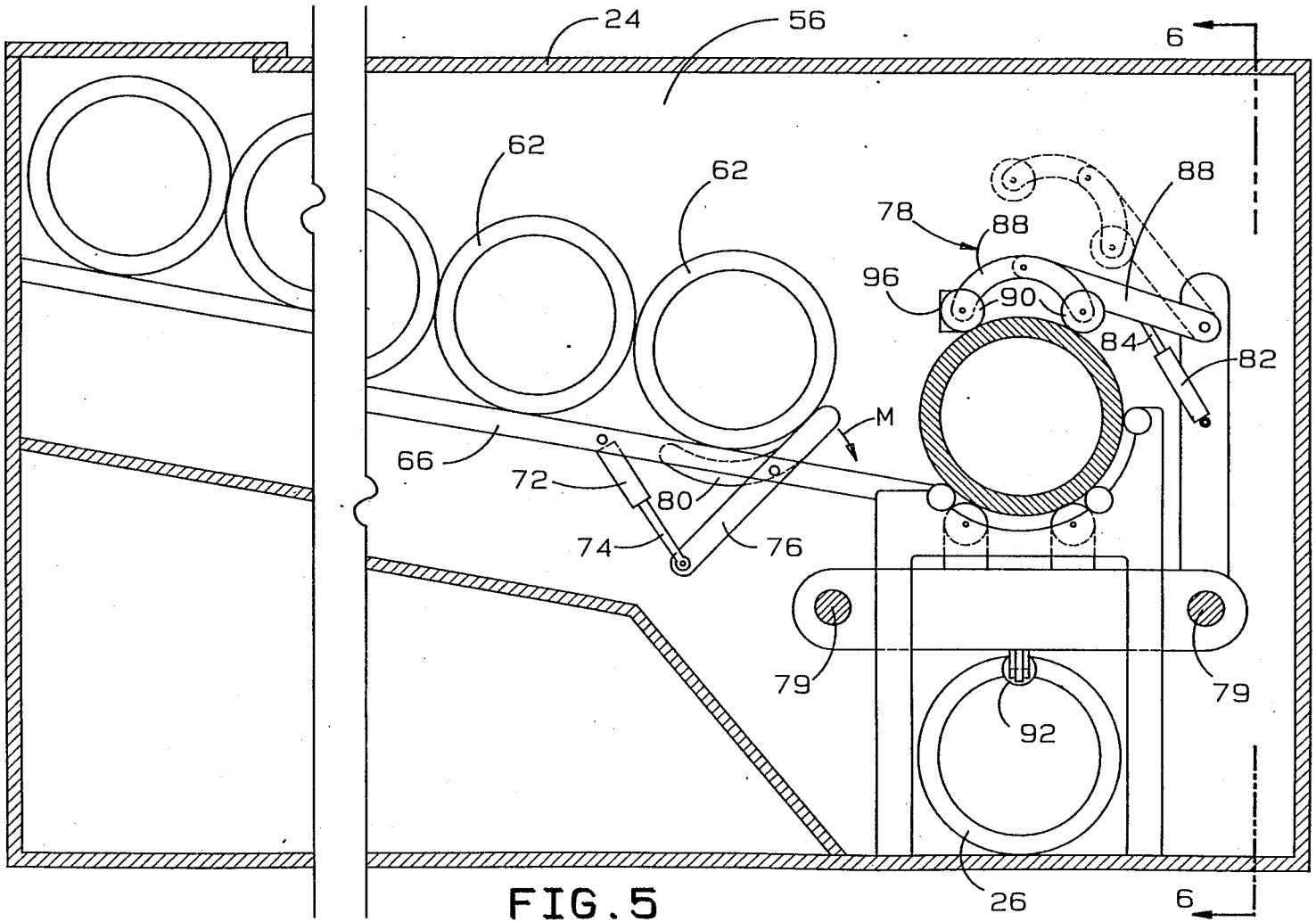
FIG. 5 is a cross-sectional end view of the unit for extending the coal conveyance pipe.
Figure 11:
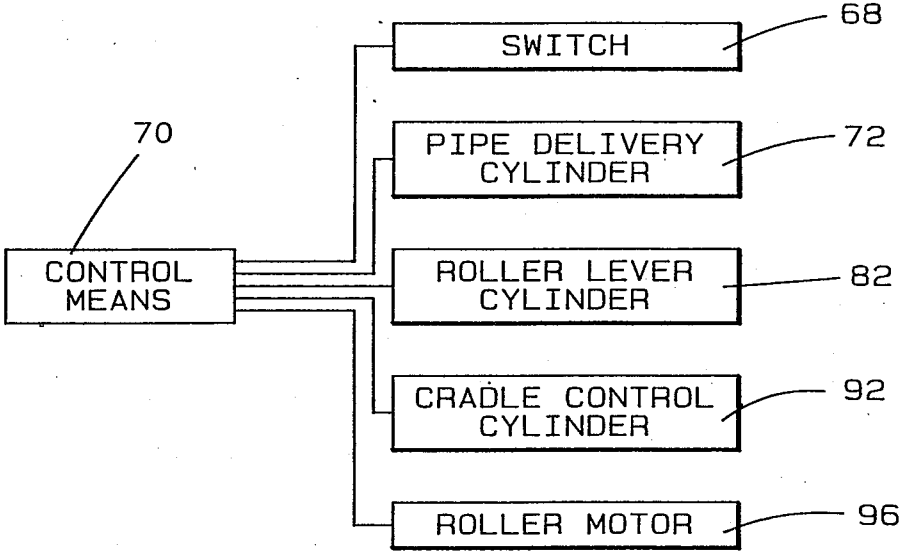
FIG. 11 is a schematic diagram of the control circuit of the present invention.
Figure 10:
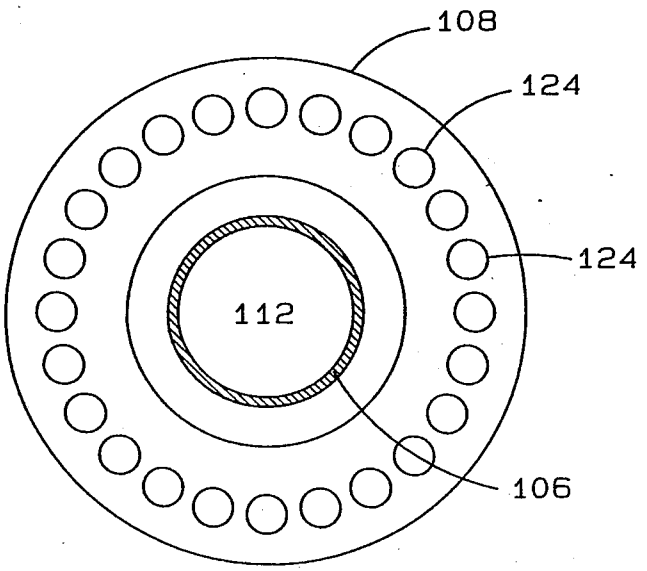
FIG. 10 is a rear elevational view of the alternative embodiment of the blocking unit of the present invention.

Means are provided in the coal conveying pipe extending unit 24 to deliver and connect an additional length of pipe 62 to the joint end 64 of the coal conveying pipe 20. As shown in FIG. 5, a series of additional pipe lengths 62 are contained in series on a ramp 66 inside the extending unit enclosure 56. As the cutting head 14 bores into the seam S, the drill pipe 16 advances into the bore hole H. Since the blocking unit 18 is connected to the drill pipe 16 through thrust bearings 36, the blocking unit 18 also advances into the bore hole H. Thus, the coal conveying pipe 20 connected to the blocking unit 18 advances into the bore hole H in the direction of arrow G in FIG. 6. When the coal conveying pipe 20 reaches the position shown in FIG. 6, the threaded joint end 64 contacts the limit switch 68. This activates the controller 70, such as a microprocessor, schematically shown in FIG. 11. As shown, the controller 70 is connected to the limit switch 68, pipe delivery cylinder 72, roller lever cylinder 82, cradle control cylinder 92 and roller motor 96 to control the entire pipe delivery and connection cycle as described below.

Following the closing of the limit switch 68 by the joint end 64 of the coal delivery pipe 20, the controller 70 first activates the pipe delivery cylinder 72. As the cylinder rod 74 is retracted into the cylinder 72, the lever 76 is pivoted downwardly in the direction of action arrow M to allow the next pipe 62 to roll down the ramp 66 into the raised pipe feeding cradle (in dashed line position) generally designated by reference numeral 78. The arm 80 of the lever 76 simultaneously pivots upwardly to engage the second pipe in line on the ramp 66 and prevent the delivery of more than one pipe to the cradle 78 at a time. After delivery of the pipe 62 the lever 76 returns to the position shown in FIG. 5.

After delivery of a pipe length 62 down the ramp 66 to the cradle 78, the cylinder 82 is activated by controller 70. As the cylinder rod 84 is retracted in the cylinder 82, the lever 86 and substantially U-shaped frame 88 are lowered to bring the rollers 90 into engagement with the pipe length 62. The controller 70 then activates the cylinder 92. As the cylinder rod 94 is extended from the cylinder 92, the pipe feeding cradle 78 is reciprocated in the direction of action arrow G along guide rails 79 to bring the threaded end 62A of the additional pipe length 62 into engagement with the cooperating threaded joint 64 of the coal conveying pipe 20.

A motor 96 connected to at least one of the rollers 90 on the feeding cradle 78 is then activated to rotate the pipe 62 in a clockwise direction and complete the threaded connection of the pipe 62 to the coal conveying pipe 20. The cradle 78 is then raised again to the dashed line position to allow the additional length of pipe 62 to be freely pulled into the bore hole by the action of the cutting head 14. As the pipe 62 is advanced, the feeding cradle 78 is returned to the position shown in FIG. 6 for receiving the next pipe length from the ramp 66 by retraction of the cylinder rod 94.

An alternative embodiment of the coal mining apparatus 100 is shown in FIGS. 7–10. As with the first embodiment, the second embodiment 100 includes a power drilling unit 102, a cutting head 104, a drill pipe 106, a blocking unit 108 and a separator 110 (see FIG. 7). In this embodiment, the drill pipe 106 is enlarged and includes an internal coal conveyance passageway 112 for the fluidized conveyance of the aggregate coal A from the enclosed chamber C adjacent the cutting head to the drill pipe extending unit 114 at the bench B (note action arrow N). The drill pipe extending unit 114 includes substantially the same internal mechanism shown in FIGS. 5 and and described in detail above to add additional lengths of pipe to the drill pipe 106 as the cutting head 104 advances into the seam S. Once the coal is delivered to the extending unit 114, it is transferred to the separator 110 through the separator delivery pipe 116.

Figure 8:
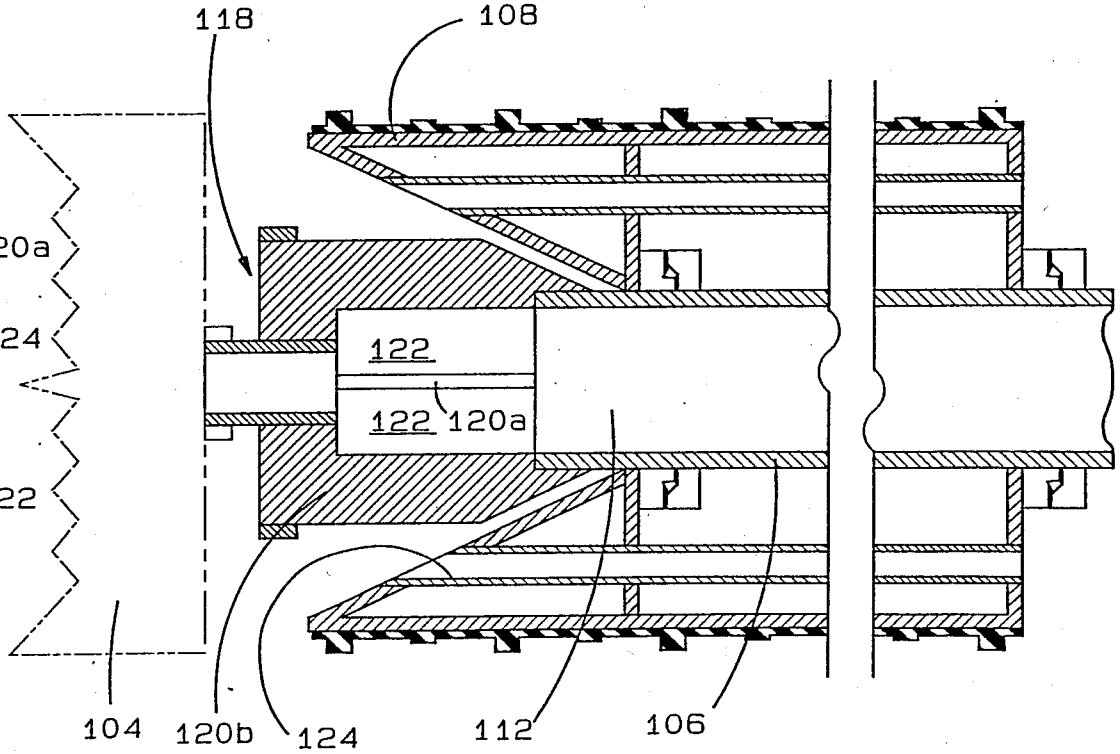
FIG. 8 is a cross-sectional view through the boring head, including the blocking unit and cutting head connector of the alternative embodiment of the present invention.
Figure 9:
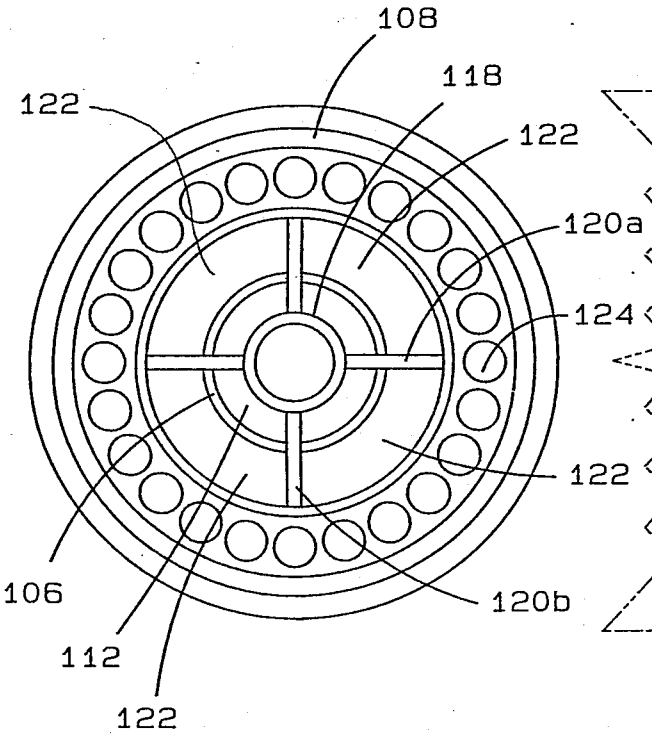
FIG. 9 is a front elevational view of the blocking unit and cutting head connector of the alternative embodiment of the present invention shown in FIG. 8 with the cutting head removed.

As best shown in FIGS. 8 and 9 in combination, the drill pipe 106 is attached to the cutting head 104 by means of a connector 118 formed from two substantially U-shaped frame members **120*a* and 120*b*. The U-shaped frame members 120*a*, 120*b* are oriented in planes substantially perpendicular to one another. Openings 122 between the frame members 120*a* and 120*b* allow communication and the passage of fluidized aggregate coal from the enclosed chamber C at the end of the bore hole H to the coal conveyance passageway 112 in the drill pipe 106**.

A power turbine 109 utilizing local natural gas or processed coal dust as a fuel, or other vacuum source known in the art, produces strong suction that is applied to the enclosed chamber C at the end of the bore hole H through the separator delivery pipe 116, drill pipe extending unit 114 and coal conveyance passageway 112 in the drill pipe 106. The fluidized coal is intercepted in the separator 110.

Vent openings 124 around the periphery of the blocking unit 108 allow air to readily enter the enclosed chamber C so as to provide the air supply necessary to fluidize the coal. That is the air entering through the vents 124 serves to lift the aggregate coal and convey the coal through the openings 122 between the connector frame members **120*a* and 120*b* and along the coal conveyance passageway 112 and separator delivery pipe 116 to the separator 110** for subsequent end use. Of course, if additional air pressure is needed to efficiently fluidize and convey the coal in the region of the blocking unit, positive pressure air lines from an air compressor (not shown) may be attached to the vent openings through a suitable manifold.

In summary, numerous benefits result from employing the concepts of the present invention. Specifically, the blocking unit 18, 108 supports the weight of the cutting head and drill pipe so as to maintain the alignment of the cutting head in the seam to depths previously unattainable in the art. Additionally, this improvement in alignment allows a cutting head of increased diameter to be used in the seam so as to allow increased coal recovery per drilling foot. The fluidized conveyance of the coal eliminates the need for auger flights and the characteristic frictional forces produced by these flights against the bore hole wall. Thus, drilling power requirements are advantageously reduced and coal mining efficiency increased.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

We claim:

1. A mining machine system for boring a hole in a coal seam, comprising:

means for boring a hole in the coal seam and reducing the coal to aggregate;

means for driving said boring and reducing means;

means for blocking the hole cut in the coal seam adjacent the boring means, said blocking means including a substantially cylindrical frame member having a diameter substantially conforming to said bore hole so as to form an enclosed chamber with an adjacent end of the bore hole, said blocking means further including an outer peripheral layer of resilient material on said substantially cylindrical frame member, said layer of resilient material serving to engage the seam surrounding the bore hole and seal the enclosed chamber; and recovery means for the fluidic conveyance of the aggregate coal from the enclosed chamber on one side of the blocking means to a collection location on an opposite side of said blocking means.

2. The mining machine system set forth in claim 1, wherein said boring and reducing means comprises a rotary cutting head.

3. The mining machine system set forth in claim 1, wherein said driving means comprises a power means and a length of drill pipe connecting said power means to said boring means.

4. The mining machine system set forth in claim 1, wherein said resilient material is rubber including a series of outwardly extending ridges for maximum sealing action with the seam surrounding the bore hole.

5. The mining machine system set forth in claim 4, wherein said rubber is neoprene.

6. The mining machine system set forth in claim 1, wherein said recovery means includes pressurized fluid source providing pressurized fluid to said enclosed chamber through said drive means.

7. A mining machine system for boring a hole in a coal seam comprising:

means for boring a hole in the coal seam and reducing the coal to aggregate;

means for driving said boring and reducing means:

means for blocking the hole cut in the coal seam adjacent the boring means, said boring means and blocking means having substantially the same diameter with the blocking means following the boring means into said bore hole, said blocking means thereby forming an enclosed chamber with an adjacent end of the bore hole; and recovery means for the fluidic conveyance of the aggregate coal from the enclosed chamber on one side of the blocking means to a collection location on an opposite side of said blocking means, said recovery means including a pressurized fluid source providing pressurized fluid to said enclosed chamber through said drive means and an aggregate coal conveying pipe that extends through said blocking means and provides communication between said enclosed chamber and said collection location; the pressurized fluid from said pressurized fluid source serving to convey the coal aggregate from said enclosed chamber through said coal conveying pipe to said collection location.

8. The mining machine system set forth in claim 7, wherein said recovery means includes pressurized air delivery means and a deflector hood for directing the aggregate coal into the coal conveying pipe.

9. The mining machine system set forth in claim 7, wherein said recovery means includes means for extending said aggregated coal conveying pipe.

10. The mining machine system set forth in claim 9, wherein said extending means includes a sealed enclosure for maintaining the increased pressure that conveys the coal through said coal conveying pipe to the collection location.

11. The mining machine system set forth in claim 10, wherein said extending means includes means for delivering additional lengths of pipe for connecting to said coal conveying pipe as said coal conveying pipe is advanced into the bore hole.

12. The mining machine system set forth in claim 11, wherein said extending means includes means for connecting said additional lengths of pipe to said coal conveying pipe.

13. The mining machine system set forth in claim 11, wherein said delivering means includes an inclined ramp and lever means for allowing the delivery of a single additional length of pipe at a time for connection to said coal conveying pipe.

14. The mining machine system set forth in claim 12, wherein said connecting means includes a cradle for receiving an additional length of pipe from said delivering means, said cradle being reciprocable substantially along a longitudinal axis of said coal conveying pipe so as to allow said additional length of pipe to be connected to an end of said coal conveying pipe within said sealed enclosure.

15. The mining machine system set forth in claim 13, wherein said cradle means further includes rollers allowing the rotation of said additional length of pipe and drive means for rotating said pipe and connecting said additional length of pipe to the end of said coal conveying pipe.

16. The mining machine system set forth in claim 15, wherein control means is provided for controlling the delivery and connection of said additional length of pipe to said coal conveying pipe; said control means including limit switch means to begin each delivery and connection cycle before the distal end of said coal conveying pipe is extended from said extending means enclosure.

17. The mining machine system set forth in claim 10, wherein a separator delivery pipe is provided communicating with said extending means enclosure for conveying said aggregate coal from said extending means enclosure to a separator.

18. A mining machine system for boring a hole in a coal seam comprising:

means for boring a hole in the coal seam and reducing the coal to aggregate;

means for driving said boring and reducing means;

means for blocking the hole cut in the coal seam adjacent the boring means, said boring means and blocking means having substantially the same diameter with the blocking means following the boring means into said bore hole, said blocking means thereby forming an enclosed chamber with an adjacent end of the bore hole; and recovery means for the fluidic conveyance of the aggregate coal from the enclosed chamber on one side of the blocking means to a collection location on an opposite side of said blocking means, said recovery means including a source of suction and said driving means including a coal conveyance passageway for conveying coal by suction through said driving means to said collection location.

19. The mining machine system set forth in claim 18, wherein said driving means includes a boring means connector having openings communicating with said coal conveyance passageway of said driving means, said openings being provided between said blocking means and said boring means in said enclosed chamber so that aggregate coal from said boring means is drawn into said coal conveyance passageway in said driving means through said openings.

20. The mining machine system set forth in claim 19, wherein said boring means connector includes two substantially U-shaped frame members oriented in planes substantially perpendicular to each other for anchoring said boring means to said driving means.

21. The mining machine system set forth in claim 20, wherein vent openings are provided in said blocking means so as to allow the entry of air into said enclosed chamber in said bore hole, the air then being drawn with the aggregate coal through said coal conveyance passageway in said driving means to said collection location.

22. A mining machine system for boring a hole in a coal seam, comprising:

means for boring a hole in the coal seam and reducing the coal to aggregate;

means for driving said boring and reducing means;

means for blocking the hole cut in the coal seam adjacent the boring means, said blocking means including a substantially cylindrical frame member having a diameter substantially conforming to said bore hole so as to form an enclosed chamber with an adjacent end of the bore hole, said blocking means further including support plates at least at each end of said substantially cylindrical frame member with each support plate including a central aperture for the receipt and free passage of said drive means;

a thrust bearing being provided between each support plate of said blocking means and said drive means, said thrust bearing allowing rotation of said drive means relative to said blocking means while also preventing longitudinal movement of said blocking means along said drive means as said boring and reducing means bores further into the coal seam; and recovery means for the fluidic conveyance of the aggregate coal from the enclosed chamber on one side of the blocking means to a collection location on an opposite side of said blocking means.

* * * * *